United States Patent [19]

Raudat et al.

[11] Patent Number: 4,878,337

[45] Date of Patent: Nov. 7, 1989

[54] CONTINUOUS MOTION TRAY TYPE PACKAGING MACHINE

[75] Inventors: John L. Raudat, North Madison; Lloyd D. Johnson, Portland, both of Conn.

[73] Assignee: Standard-Knapp, Inc., Portland, Conn.

[21] Appl. No.: 278,817

[22] Filed: Dec. 2, 1988

Related U.S. Application Data

[62] Division of Ser. No. 47,244, May 6, 1987, Pat. No. 4,793,117.

[51] Int. Cl.[4] ..... B65B 35/44; B65B 21/00

[52] U.S. Cl. ..... 53/534; 53/207; 53/543

[58] Field of Search ..... 53/534, 207, 209, 48, 53/157, 543; 198/419.3, 732

[56] References Cited

U.S. PATENT DOCUMENTS

| | | | |
|---|---|---|---|
| 3,190,434 | 6/1965 | Dardaine | 198/419.3 |
| 3,194,382 | 7/1965 | Nigrelli | 53/543 X |
| 3,718,246 | 2/1973 | Dardaine | 198/419.3 |
| 3,845,852 | 11/1974 | Langen | 198/732 X |
| 3,929,220 | 12/1975 | Powel | 198/732 |
| 4,079,571 | 3/1978 | Schlueter | 198/732 X |
| 4,424,658 | 1/1984 | Focke | 53/209 X |
| 4,642,967 | 2/1987 | Culpepper | 53/209 X |

FOREIGN PATENT DOCUMENTS

| | | | |
|---|---|---|---|
| 1329665 | 7/1973 | United Kingdom | 53/207 |

*Primary Examiner*—John Sipos

*Attorney, Agent, or Firm*—McCormick, Paulding & Huber

[57] ABSTRACT

Articles, such as glass containers, are fed continuously in end-to-end relationship through a pin spacer adapted to provide a space between adjacent rows so that cross partitions can be fed therebetween. The articles are then grouped by s pin type grouper to provide predetermined members of article rows and columns in each group. The columns of articles are then spread slightly to allow longitudinal extending partitions to be fed between adjacent columns. At the same time flat tray blanks are withdrawn from a horizontally extending magazine and provided on a lug conveyor located below the path of the grouped articles and each blank is mated with a group of articles at a load station where the blank is formed around the articles by a pocket chain conveyor and article folding means operated in conjunction with an overhead flight bar conveyor which cooperates with the trailing portion of each pocket to fold all flaps provided on the tray blank.

5 Claims, 14 Drawing Sheets

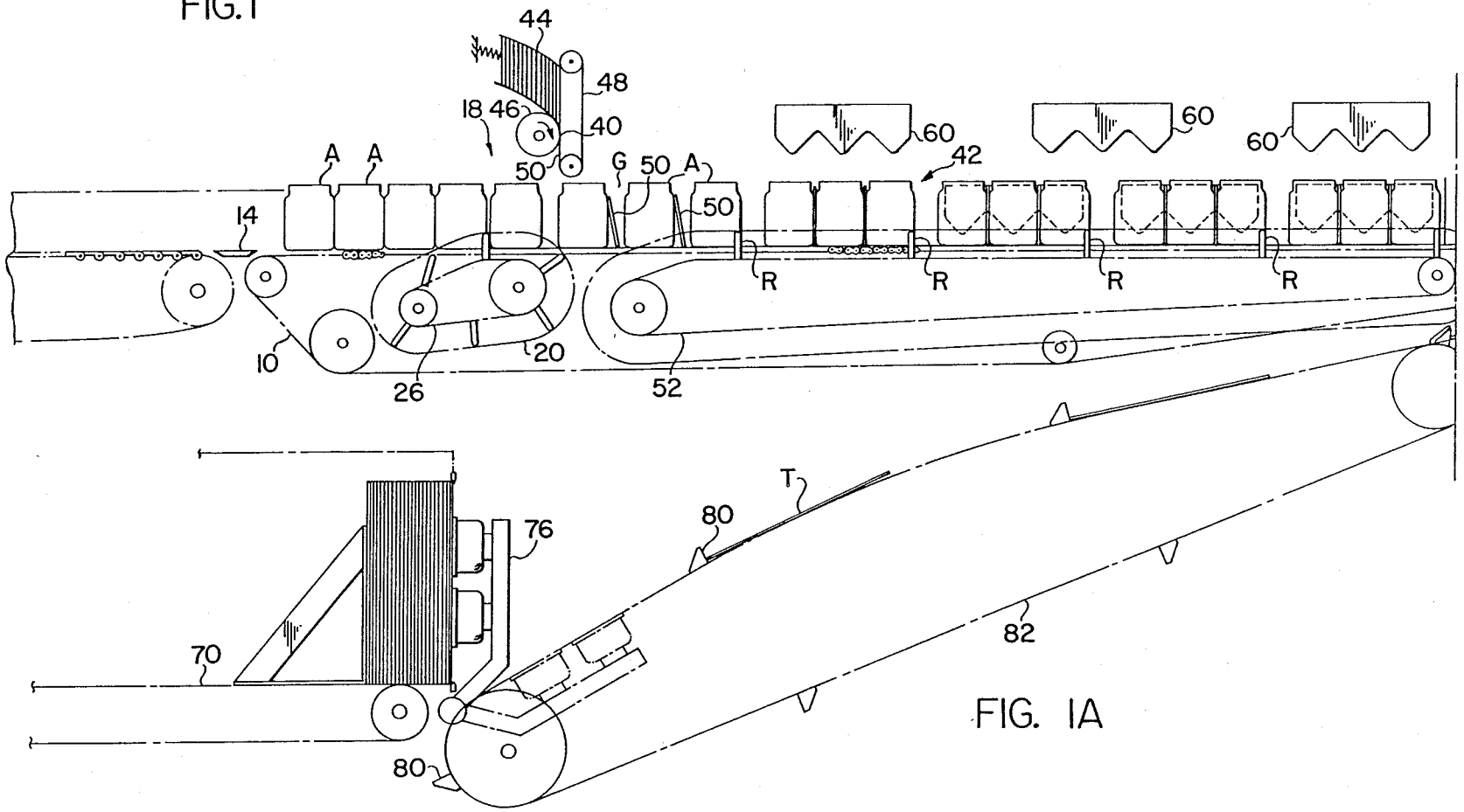
FIG. IA
FIG. IA | FIG. IB
FIG. I

CONTINUOUS MOTION TRAY TYPE PACKAGING MACHINE

BACKGROUND OF THE INVENTION

This application is a division of copending application Ser. No. 047,244, filed May 6, 1987 and now issued as Patent No. 4,793,117. The above mentioned copending application illustrates the invention claimed in the subject application but claims only the invention in association with means for inserting partitions between spaced article lanes and between spaced article rows. The present application claims the means for achieving this spacing in greater detail, and it is noted that the advantages to the invention claimed herein can be realized without necessarily including apparatus and means for inserting partitions between said spaced article rows. For example, spacing the individual rows and subsequently handling predetermined rows in a slug of articles avoids the necessity for spacing the slugs and encountering a concomitant multiplier effect on the dimensional tolerances involved with respect to the articles being handled.

The present invention relates to a tray packaging apparatus for continuously packaging groups of articles on a paperboard tray, and providing partitions between the adjacent articles in each group as that the tray and articles can be provided with a heat shrinkable plastic film.

While continuous motion packaging machines have been proposed in the past, those especially suited to loading shallow cartons such as trays have generally required that the tray or carton be formed prior to arrival at the loading station where the trays are mated with a slug of articles. For example, Nigrelli No. 3,194,382 illustrates such an approach to continuously loading trays with cylindrically shaped articles. This prior art disclosure suffers from the disadvantage that the tray must first be erected from its flat blank configuration for use in such a machine.

Prior art apparatus for forming tray blanks around groups of articles generally require that the flap folding take place at a stationary location in the machine, that is, the tray blank must be stopped in order to fold all flaps on the tray blank upwardly and to assure that the corner tabs are properly attached to these flaps. See for example Nigrelli patent No. 3,454,149.

Where trays are formed in a continuous fashion for receiving groups of articles the complexity of the resulting machinery has reduced the market for such machines. See for example patents No. 3,832,826 to Ullman and No. 3,683,755 to Latke wherein either the group of articles or the tray forming mechanism must be rotated through at least 180 degrees in order to avoid the stopping of the product flow characteristic of prior art intermittent motion tray type packaging machines.

Finally, the next step in developing a continuous motion machine for erecting tray blanks and filling the trays with groups of articles appears to be that developed by Monaghan in patent No. 3,842,570 wherein the tray blank is mated with a slug of articles, and wherein the tray flap folding apparatus moves downstream with the group of articles to achieve the requisite folding of the flaps upwardly around the article group without interrupting the downstream movement of both. This prior art apparatus, like the rotary tray forming machines referred to previously, suffers from the disadvantage that a complex mechanism is required to be phyically moved downstream with the articles in order to achieve the continuous packaging required. The present invention seeks to avoid this reciprocatory or return movement of a complex mechanism, and also avoids the complexity of rotating either the group of articles or the tray blank itself as is characteristic of the prior art apparatus described in the preceeding paragraph.

Another object of the present invention is to provide a continuous motion tray forming and packaging machine adapted to handle tray blanks and continuously fed articles, and also to provide lateral and longitudinal partitions between the adjacent articles in each group prior to mating of the group with the tray blank itself. In this respect the present invention represents an improvement over prior art patent No. 3,760,557 issued to McIntyre.

SUMMARY OF THE INVENTION

In its presently preferred form the continuous motion tray forming product loading means according to the present invention includes individual lane conveyor means for providing a plurality of side-by-side columns of articles, and advancing these article columns downstream continuously in rows. First article engaging pin means provided below the path of movement of these articles slows each side-by-side row of articles to create a space between it and preceding row. If desired means is provided above the path of movement of the articles for inserting cross partitions between these spaced rows. Lane divider means includes means for shifting one lane of articles away from an adjacent lane to provide a longitudinal space therebetween, and means may also be provided for inserting longitudinal partitions between these spaced article columns. The partitions preferably have cooperating notches that allow nesting of the cross partitions with the longitudinal partitions. The longitudinal partitions are carried downstream by the cross partitions in the group of articles. Second article engaging pin grouper means form the groups of articles for filling a tray with a predetermined number and the pin grouper means also operates from below the path of movement of the articles to form the successive groups on the continuously moving underlying individual lane product conveyors. Arranged below the path of movement of the articles and generally below these pin conveyors in a magazine for storing tray blanks on edge, with means provided for withdrawing these blanks and depositing each blank in turn on a upwardly and forwardly inclined lug conveyor which transports the flat blanks toward a load station where each blank is mated with an associated group of partitioned articles. An overhead flight bar conveyor takes each group of articles from the downstream end of the individual lane conveyors and feeds the group through the load station in timed relationship with arrival of a tray. The leading edge of the tray has its front flap folded by the leading flight bar in a pocket chain conveyor, and the rear flap is folded by the rear or trailing side of the pocket chain conveyor. A continuously rotating corner tab folding device is provided for folding the rear flap corner tabs forwardly without interrupting movement of the group and the tray downstream in the pocket chain conveyor. These side flaps are then plowed upwardly by conventional means with adhesive being applied prior to movement of the tray blank through a compression section in order to set the adhesive. The resulting product is well suited to shrink wrap final packaging in a conventional shrink film application process.

BRIEF DESCRIPTION OF DRAWINGS

FIGS. 1A and 1B are side elevational views showing in somewhat schematic fashion the overall layout of a preferred embodiment of the present invention.

DETAILED DESCRIPTION

Figure 1B:
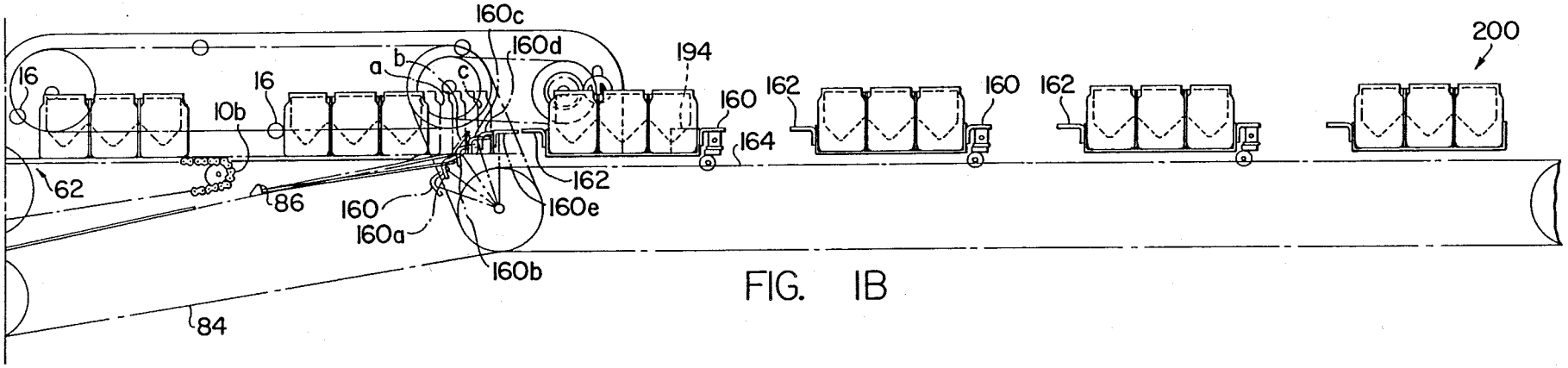
Figure 10:
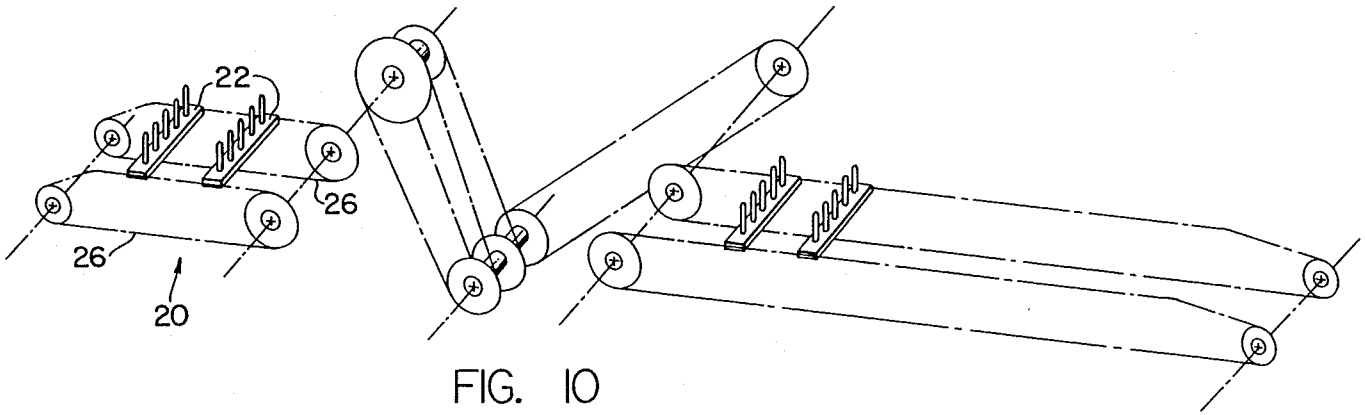
FIG. 10 is a perspective view illustrating the input drive shaft and clutch brake system provided for operating the pin spacer conveyor and pin grouper conveyor.
Figure 15:
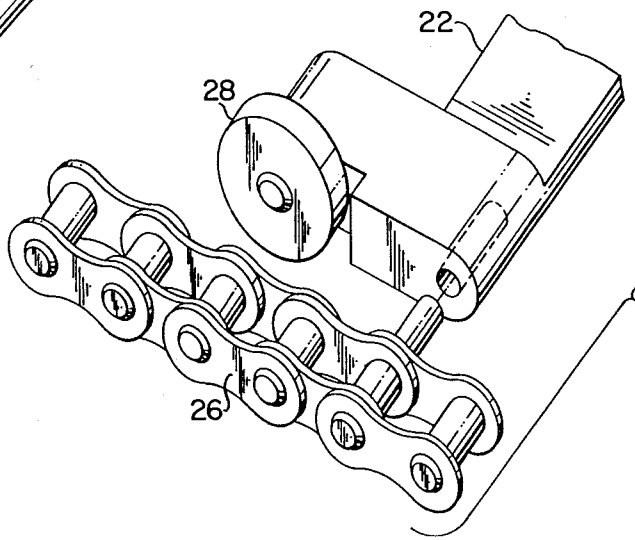
FIG. 15 is a perspective view illustrating the mounting arrangement between the pin conveyor chain and pin supporting assembly.

Turning now to the drawings in greater detail, FIG. 1 shows the overall machine for continuously forming trays and corresponding groups of articles in a continuous motion in-line machine wherein the articles A, A are fed from left to right onto the upstream end of individual plate type lane conveyors 10, 10 between lane guides 12, 12. These individual side-by-side lane conveyors are adapted to feed the product in side-by-side relationship from the deadplate 14 downstream to be picked up by an overhead flight bar 16, this after the articles have been formed into groups and provided with separating partitions in a manner to be described. As so constructed and arranged the product is provided on the side-by-side individual lane conveyor means 10, 10 in a plurality of advancing columns, and in rows such that the articles are side-by-side. With the articles so arranged a first article engaging pin spacer means is provided below the path of movement of the articles on these lane conveyors 10 for slowing each row of side-by-side articles to create a space between adjacent rows as suggested generally at 18 in FIGS. 1 and 2. This article engaging pin means comprises a plurality of side-by-side pins arranged on laterally extending pin support bars 22, 22 best shown in FIGS. 10 and 12. As shown in FIG. 10 the ends of these bars 22 are mounted to conveyor chains 26, 26 either directly to the insides of the chains by extended chain pins on the chains as shown in FIG. 15 or by providing an offset end portion or connecting portion as shown in FIG. 12A so that a portion of the pin supporting cross bar **22*a* is provided outside the path of movement of the chain 26 to receive cam roller 28. In the version illustrated in FIG. 12 cam roller 28 is provided inside the path of movement of the chain 26 whereas in the version shown in FIG. 12A the cam roller 28 is provided outside the path of movement of the chains 26, 26**.

Figure 13:
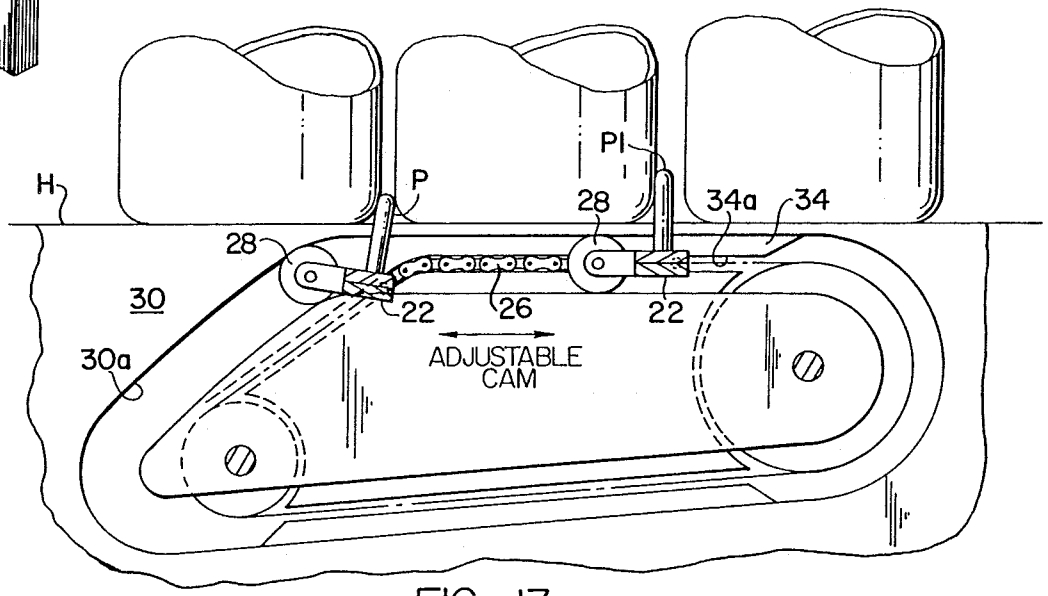
FIG. 13 is a schematic side elevational view of the adjustable cam assembly provided with the pin mounting arrangement of FIG. 12.

FIG. 13 illustrates the configuration for the cam defining means for controlling the angular configuration of the pin support bar 22 as the pins move upwardly through the horizontal plane defined by the upper surface of the individual lane conveyors or plate conveyors 10, 10. This surface is indicated generally at H in FIG. 13 and it will be noted that pin P is so cammed that it is inclined forwardly as shown generally by the inclined pin P in this view. The cam slot defining structure 30 serves to provide this camming action. While the pin P is inclined forwardly as shown in FIG. 13 the preceding pin P1 is oriented vertically as a result of the configuration for the cam slot **30*a*. Cam slot 30*a*** cooperates with a track provided for the chain itself in order to determine the angular orientation of the pin P as it penetrates the horizontal surface H defined by the lower surfaces of the articles.

Figure 14:
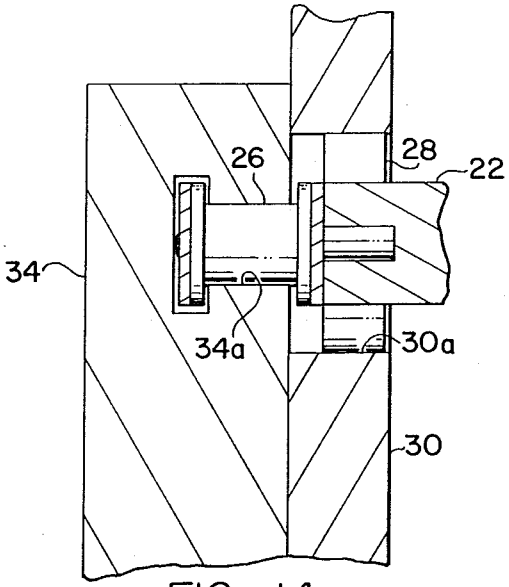
FIG. 14 is a vertical sectional view through one of the conveyor chains in the pin spacer or pin grouper conveyor.

Thus, the pin P can provide a predetermined pitch with the downstream vertically oriented pin P as dictated by the angle of pin P caused by the roller 28 moving up the inclined slot **30*a*. This pitch will serve to accommodate a bottle of predetermined diameter. If a large diameter bottle or jar is to be accommodated means is provided for shifting the cam slot defining structure 30 so that the roller 28 will cause pin P to lean in the opposite direction as it penetrates the surface H. This means for so adjusting the cam structure 30 as shown at 35 in FIG. 13, and comprises a rack gear provided on the cam structure 30 and a spur gear provided on a rock shaft rotatably supported in the machine frame. Such adjustment means allows the pin spacer means to be adjusted for different product size while the machine is operating. FIG. 14 illustrates the track defining block 34 and associated track defining slot 34***a* for the chain 26.

Figure 13A:
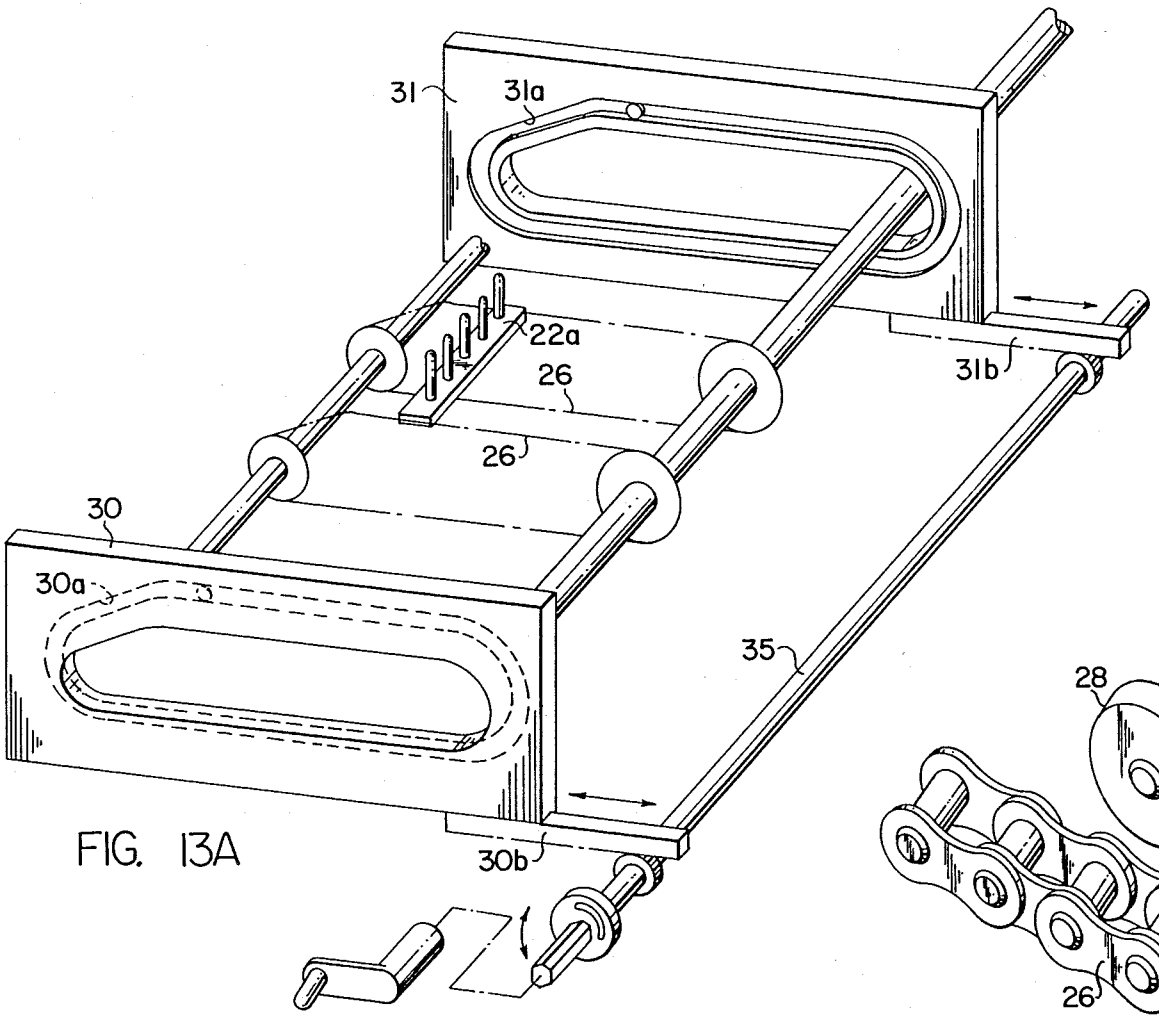
FIG. 13A is an exploded view of the cam structure provided for tilting the pins of the FIG. 12A conveyor.

FIG. 13A shows this adjustment means with the preferred pin supporting cross bar 22*a* of 12A. Left and right cam structures 30 and 31 include rack gear segments and cam tracks 30*a* and 31*a*. The roller chains 26, 26 follow fixed tracks such as suggested at 34*a* in FIG. 14 for example. Pin supporting cross bar 22*a* has rollers 28 on offset end portions (to permit the chain support tracks to be located inboard of the chains) and these rollers 28 follow the cam slots 30 and 30*a* to pivot the pins P as these pins penetrate the plane H defined previously. A rock shaft 35 provides the means for shifting these cam slots 30*a* and 31*a* by racks 30*b* and 31*b* provided on the cam structures 30 and 31 respectively.

Figure 12:
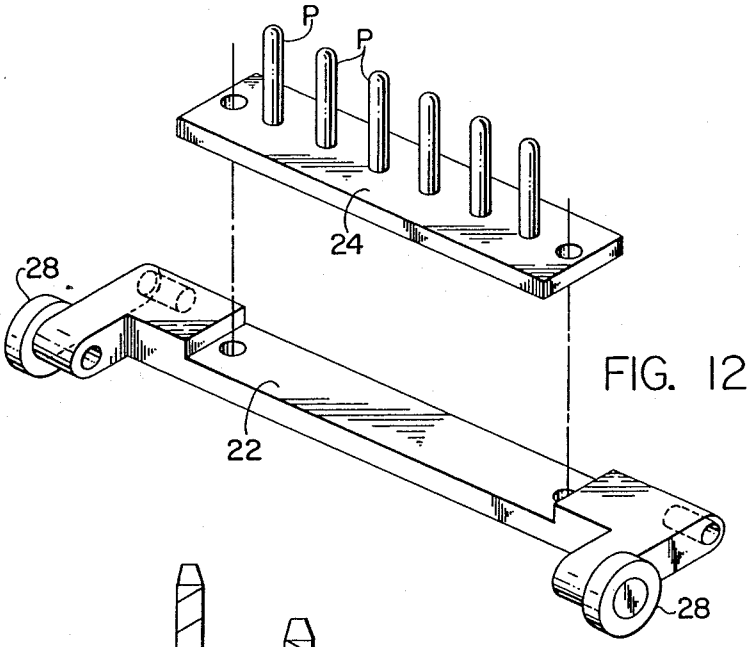
FIG. 12 is a perspective view illustrating the construction for one version of a pin supporting plate and associated change pin subassembly.
Figure 12A:
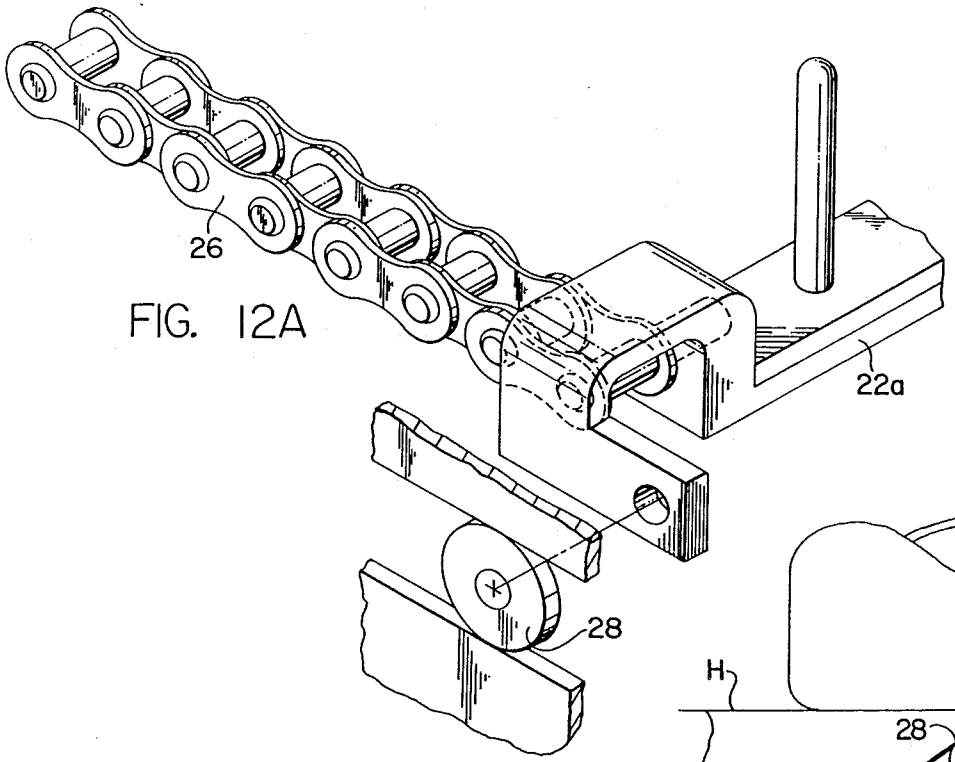
FIG. 12A is similar to FIG. 12 but illustrates a slightly different embodiment for this portion of the pin conveyor assembly wherein the cam track is provided laterally outwardly of the conveyor chain.

As best shown in FIG. 12 the tiltable pins P, P are provided on a removable pin assembly 24 mounted to the flight 22 by screws (not shown). Replacement of these pin assemblies may also be required to accommodate bottles of significantly different diameter.

Figure 9:
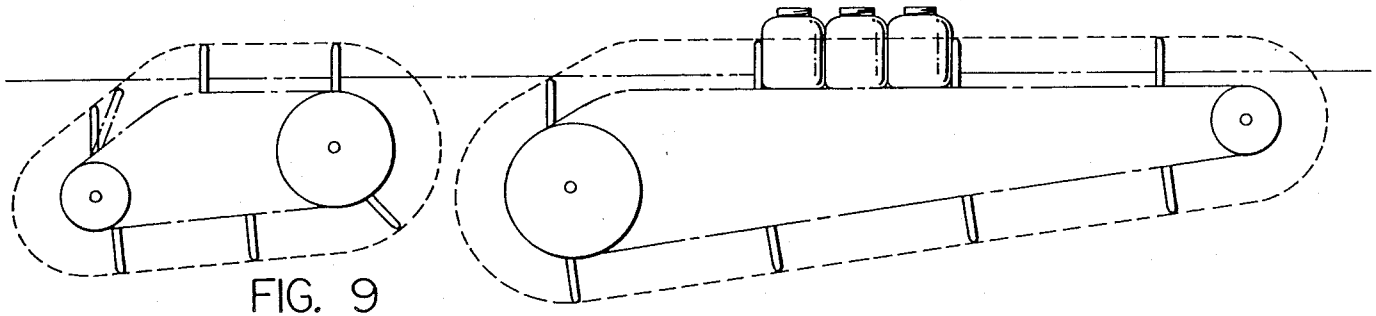
FIG. 9 illustrates in schematic fashion the geometrical relationship between the pin spacer subassembly and the pin grouper subassembly relative to the individual lane conveyor slip chain.
Figure 11A:
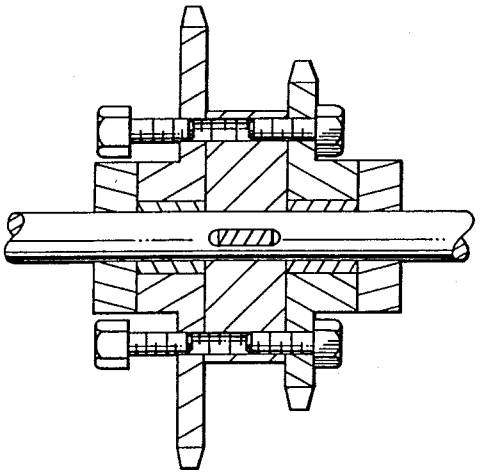
FIG. 11A is an alternative clamping configuration capable of adjusting the relative positions of the pin conveyors and also achieving the drive ratio changes possible with the FIG. 11 mechanism.
Figure 11:
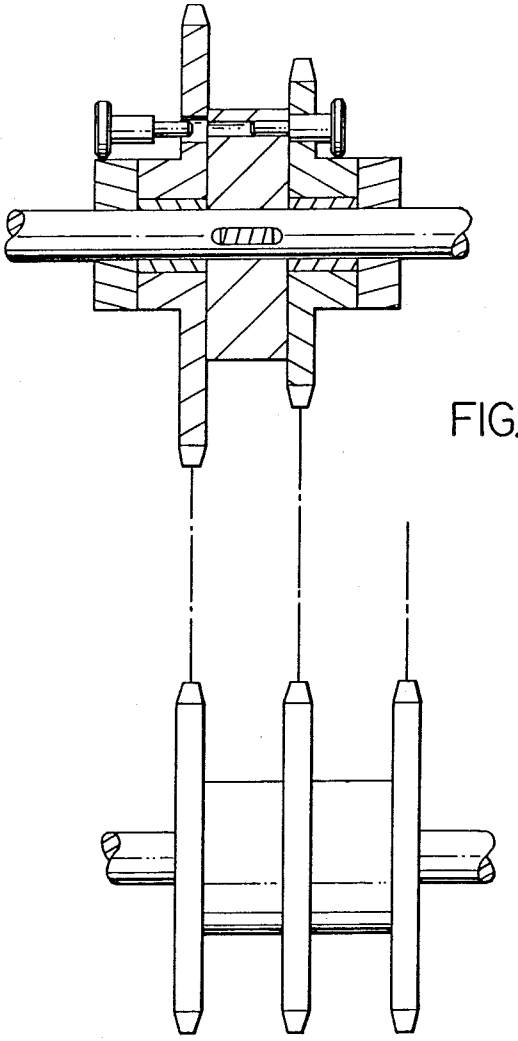
FIG. 11 is a detail view of a portion of the apparatus illustrated in FIG. 10 showing the means for changing the drive ratio between these pin conveyors.

FIG. 11 shows one mechanism for changing the speed ratio between the spacer pin conveyor just described and the pin grouper conveyor where the product is provided in the pattern required for mating with a tray. FIG. 9 shows the layout for the common drive elements, and the FIG. 11 mechanism provides alternative coupling means for these conveyors. As suggested in FIG. 9 the mechanism of FIG. 11 not only provides for two distinct speed ratios between these conveyors, but should also provide for adjusting their positions relative to one another. Substituting slotted clamp plates and screws for the pin type coupling device of FIG. 11 will provide this capability. See FIG. 11A for a preferred embodiment for such a clamping feature.

Referring once again to FIG. 1, the decelerating effect of the pin spacer conveyor will result in a gap G being provided between adjacent rows of articles so that a cross partition 40 can be dropped downwardly into this space and carried along by the following row until the articles are again compressed into an orderly group as suggested generally at 42 in FIG. 1. While any convenient means might be provided for storing cross partitions and feeding them downwardly between these gaps G, G successively formed by the pins spacer conveyor described above I prefer to provide individual magazines 44 for the partitions and to intermittently advance the endmost cross partition away from the end of the stack in the magazine by cooperating roller 46 and backup conveyor 48.

The individual lane conveyors 10 move the separated rows of articles A, A with the cross partitions 50 provided therebetween onto the upstream end of a second pin conveyor or pin grouper conveyor 52 comprising cross flights similar to those described above with reference to the pin spacer conveyor. Each cross flight has pins provided with camming devices so that the pins move upwardly through the horizontal plane H defined by the lower surface of the articles and by the upper run of the individual lane conveyors 10. The pins R, R so provided on these flights or bars are so spaced longitudinally relative to one another as to form groups of articles on the underlying lane conveyors 10.

The configuration and construction for this second or pin group conveyor 52 need not be described in detail as the construction is similar to that of the pin spacer conveyors referred to previously. Two side-by-side chains carry the spaced cross flights either inside or outside the camming means.

Figures 2, 2A:
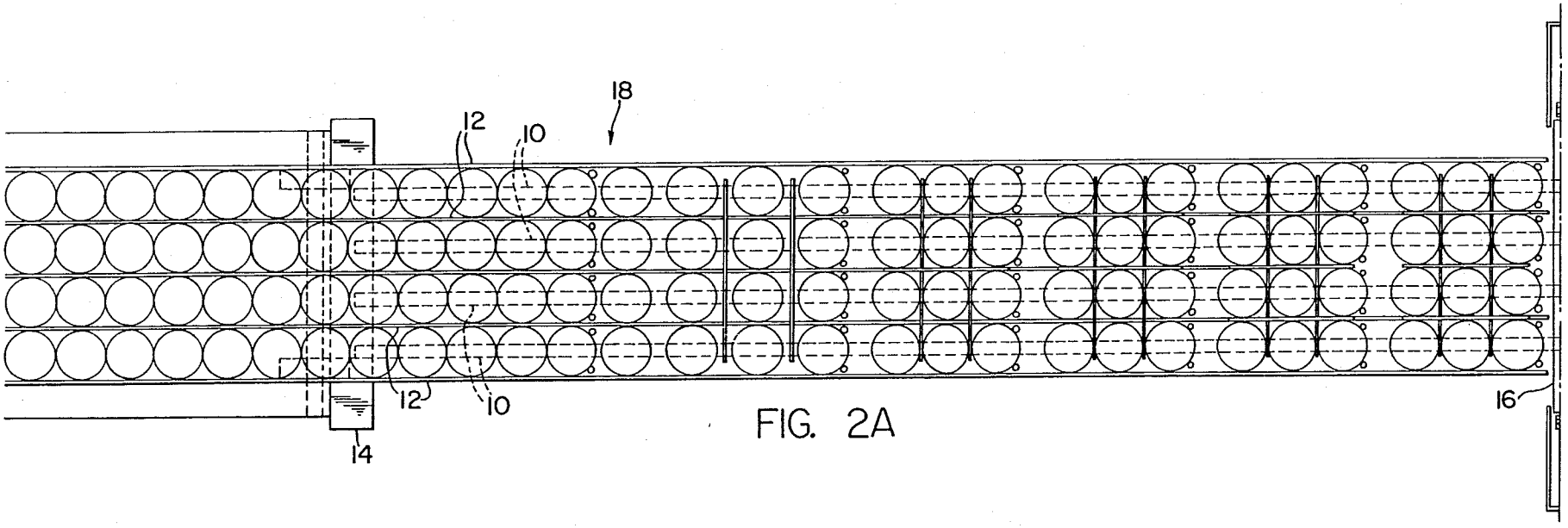
FIGS. 2A and 2B are a plan view of the apparatus illustrated in FIG. 1.
Figure 2B:
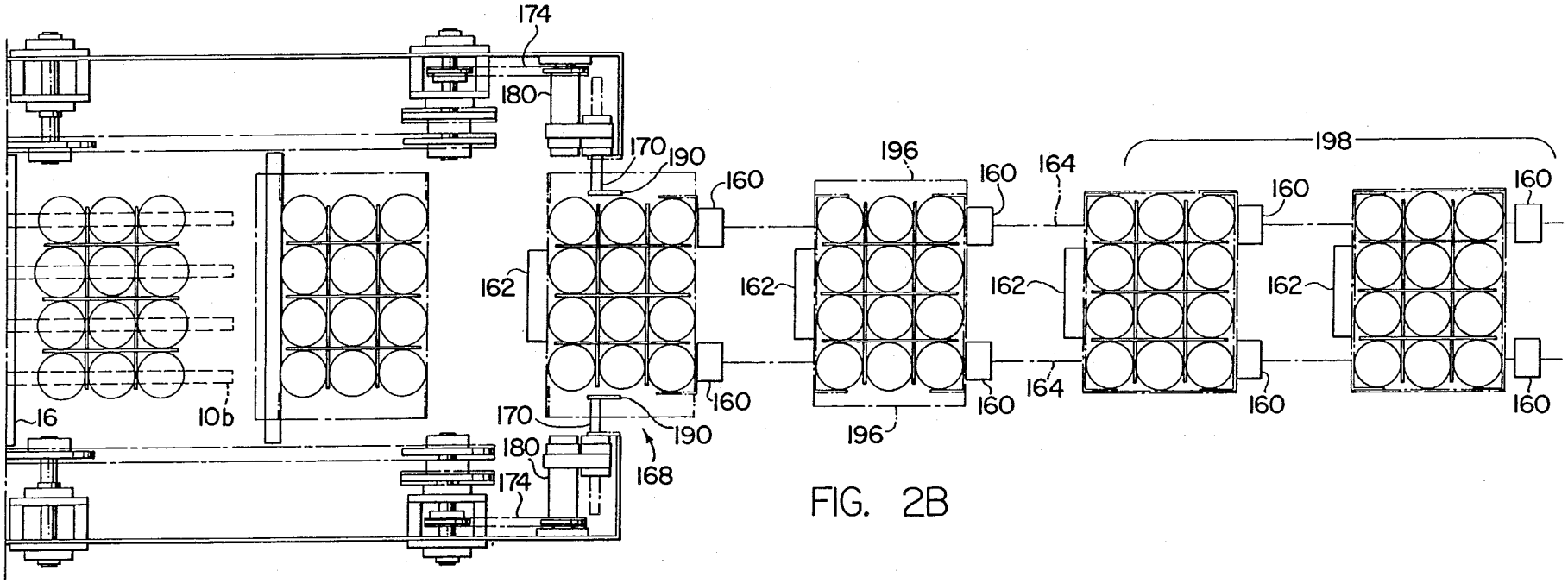

As the articles are moved in groups downstream by the underlying lane conveyors 10, 10 under the control of the grouper pins R, R lane divider means best shown in FIG. 2 between the columns or article lanes serves to shift the columns of articles away from one another to provide a longitudinally extending space therebetween. Longitudinally extending center and outer partitions 60, 60 are fed downwardly into these spaces and the center and outer partitions have downwardly open notches that mate with upwardly open notches in the cross partitions 40, 40 to provide separation between the adjacent articles in the group, all while the groups are fed continuously downstream by these lane conveyors 10, 10 under the control of the pin grouper conveyor means R, R. These pins R, R serve to achieve a sliding or slipping motion between the underlying lane conveyor plates and the articles A, A, which relative slipping is allowed to continue until the downstream end of the pin grouper conveyor 52. At this point, indicated generally at 62 in FIG. 1, an overhead flight bar 16 enters the space between the groups to advance the group off the end of the individual lane conveyors 10, 10. The downstream end of the individual lane conveyors is indicated generally at 10*b* in FIGS. 1 and 2. These flight bars 16, 16 serve to advance the slugs or groups of articles into a load station where the groups of articles continue to move as they are mated with a tray blank fed to this load station by blank transport means to be described.

Figure 3:
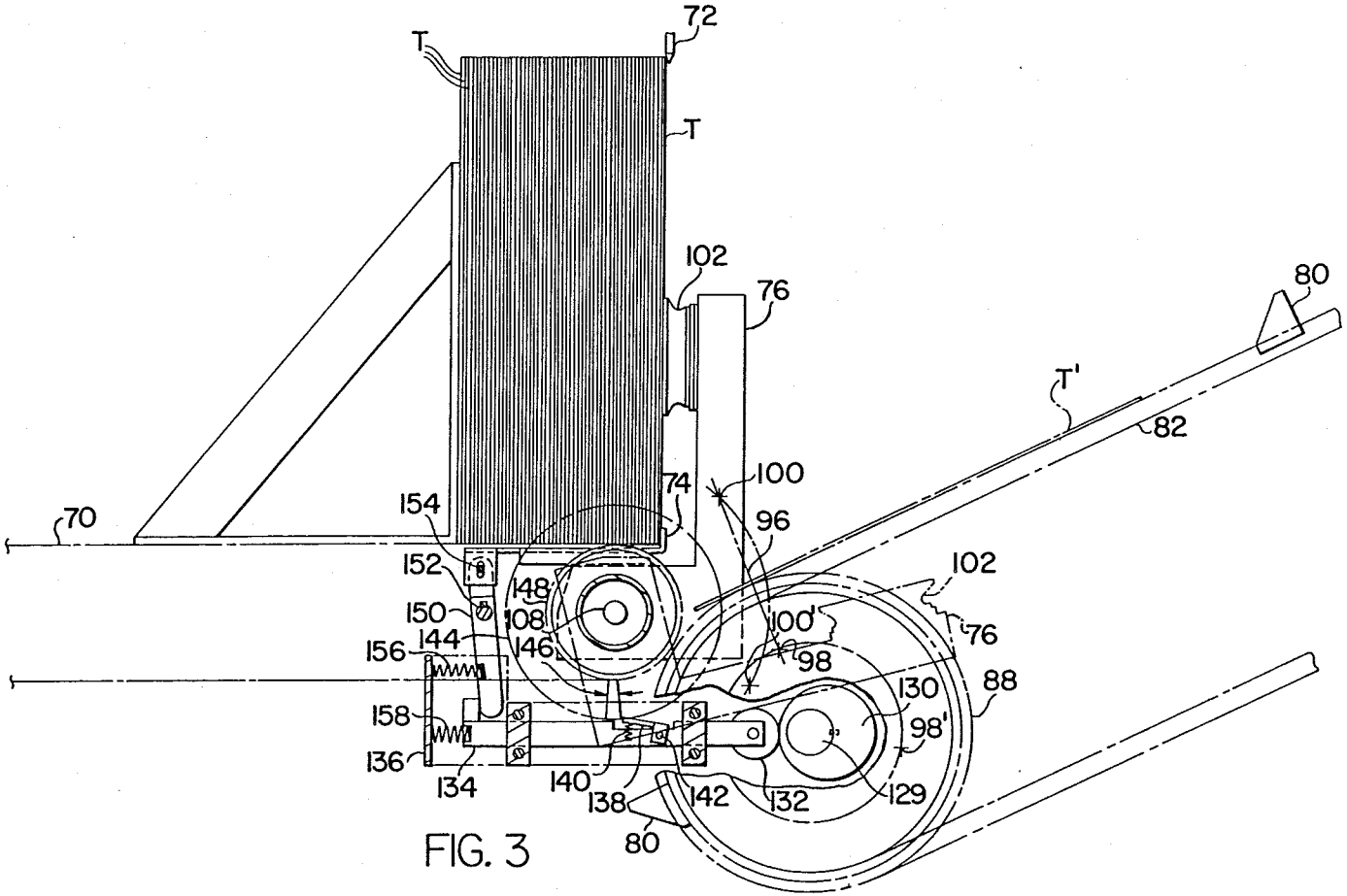
FIG. 3 is a detailed side elevational view of the tray blank magazine and associated means for withdrawing the endmost blank in the magazine for deposit on the blank transport means, the blank withdrawal arm being illustrated in solid lines and in broken lines at two angularly spaced positions for accomplishing this tray blank movement.
Figure 4:
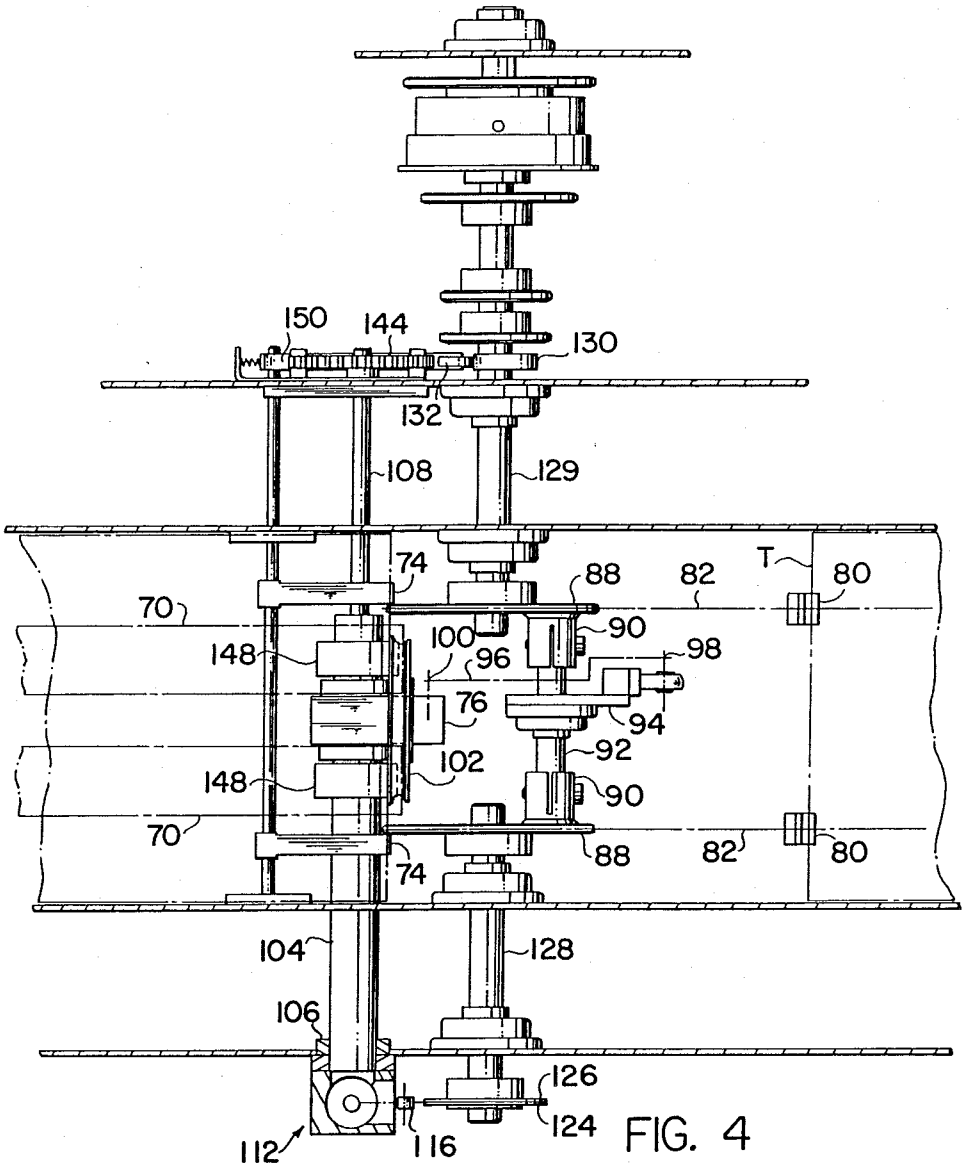
FIG. 4 is a plan view of the apparatus illustrated in FIG. 3.

FIGS. 3 through 6 inclusively show the magazine means for storing tray blanks on edge below the path of the articles moving on the individual product conveyors as best shown in FIGS. 3 and 4. These views also show the means for withdrawing or extracting the endmost blank from the magazine and providing the blanks seriatim in the path of a blank transport means in the form of a lug conveyor which is best shown in FIG. 1.

The magazine means comprises at least two horizontally arranged delrin plate chain conveyors 70, 70 which conveyors are intermittently driven by a short distance, somewhat greater than the thickness of each individual tray blank, in order to bias the stack of tray blanks T, T from left to right in FIGS. 1 and 3 toward stops 72 and 74. Stop 72 comprises a fixed knife edge for engaging the upper edge of the endmost tray blank as shown in FIG. 3, and the stop 74 for engaging the lowermost edge of the same blank is intermittently moved in timed relationship with movement of the conveyor chains 70. As so constructed and arranged the endmost blank is released for movement under the control of arm 76 from the position shown in FIG. 3 to the position indicated generally at T′ where the blank is adapted to be moved by lugs 80 on lug conveyor chain 82 for transport upwardly and to the right in FIG. 3. Each blank is in turn picked up by a second lug conveyor 84 having lugs 86 similar to those illustrated in FIG. 3. The tray blank is ultimately mated with an associated group of articles to be packaged at a load station where both the tray and group of articles are continuously moved as the tray blank is folded upwardly around the lower portions of the articles.

Still with reference to the magazine means and the blank withdrawal means of FIG. 3, the intermittently operated arm 76 is driven by the same sprocket or set of sprockets 88, 88 best shown in FIG. 4 that continuously operate the lug conveyors 82 and 84. As shown in FIG. 4 each of the sprockets 88 and 88 carries an eccentric socket 90, which sockets 90, 90 are pinned to the ends of a rock shaft 92. The midpoint of the rock shaft supports a crank arm 94 and a link 96 is pivotally connected at one end to the free end portion of the crank arm 94 as shown generally at 98. The other or opposite end of link 96 is privotally connected to the arm 76 as indicated generally at 100. The link 96 is illustrated schematically in FIGS. 3 by the broken line shown between points 100 and 98 in this view. Since point 98 is restricted to movement in the circle defined by the shaft on which sprocket 88 is mounted the end of link 96 connected to this point 98 will move from the position shown for it in FIG. 3 to the position indicated generally at 98' in this view. At the same time the point 100, to which link 96 is connected on the arm 76, will necessarily move on the radius shown from the position shown at 100 to the position shown at 100' is this view. Thus, link 76 will be moved from the solid line position shown in FIG. 3 to the broken line position shown in this view in a motion designed to withdraw the endmost blank from the magazine and lay the blank on conveyor chains 82 and between the lugs 80 provided on this chain.

Figure 5:
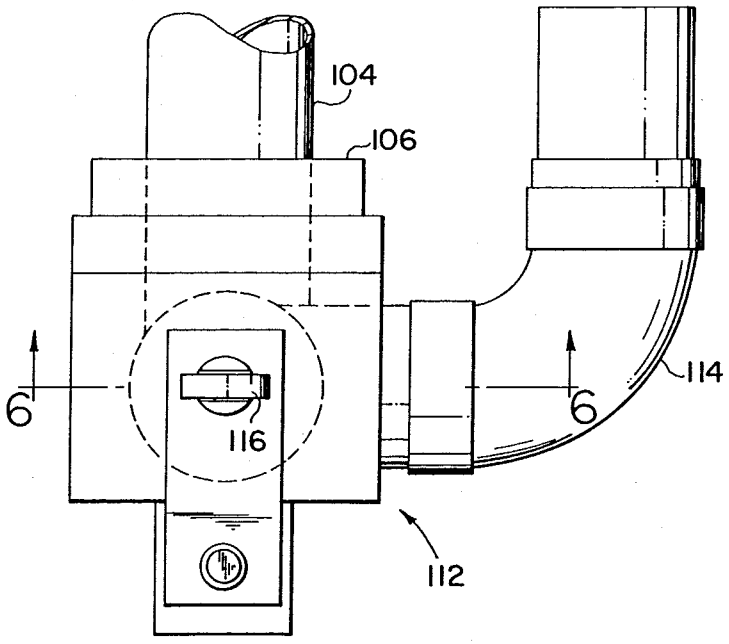
FIG. 5 is a vertical sectional view taken generally on the line 5—5 of FIG. 4.
Figure 6:
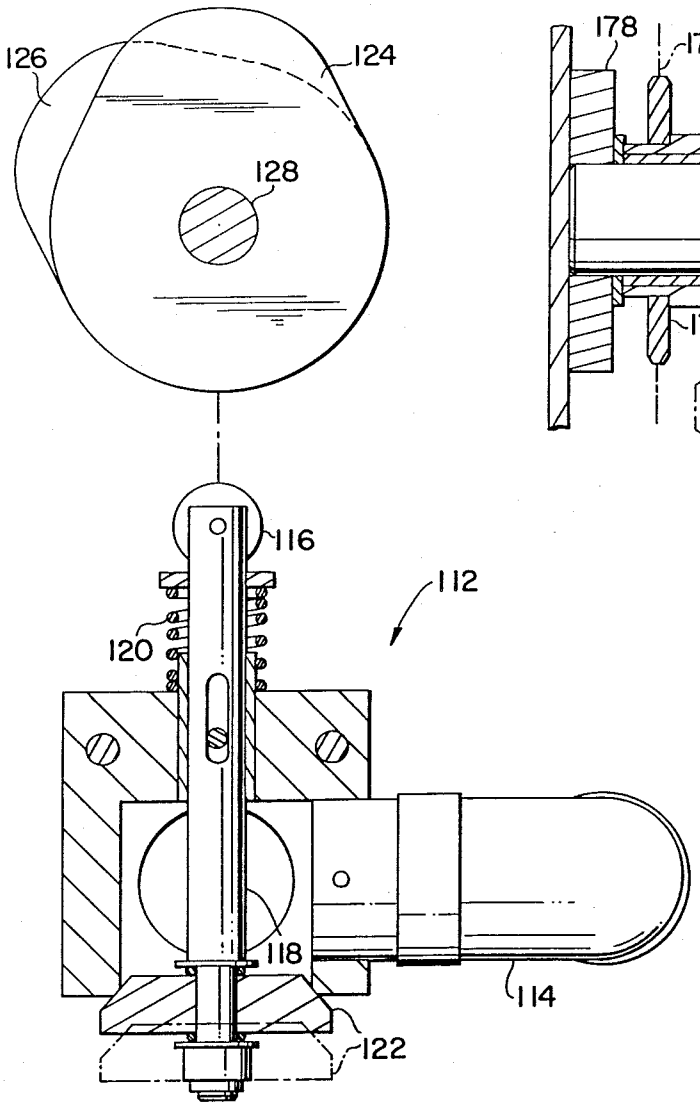
FIG. 6 is a vertical sectional view taken generally on the line 6—6 of FIG. 5.

Arm 76 includes a vacuum pickup device 102 for engaging the endmost blank in the stack and this vacuum cup 102 is connected to a low pressure source (not shown) through the hollow interior of the arm itself, which are interior communicates with the hollow interior of a tubular shaft 104 supported at one end of the magazine in a bearing block 106 and supported at its opposite end by a stub shaft 108 that is in turn supported in a bearing 110 at the opposite side of the magazine. Thus, cross shaft 104/108 is rotatably supported below the stack of blanks in the magazine, and at the same time serves as a conduit low pressure air to the vacuum pickup head 102 on the movable arm 76. A valve 112 best shown in FIGS. 5 and 6 is provided adjacent the bearing 102 and serves to periodically connect the interior of shaft 104 to the vacuum source (not shown) through a conduit 114. FIG. 6 shows the valve in some detail and shows a cam follower roller mounted on a central post 118, together with a spring 120 for biasing the post upwardly to close dump valve element 22 at one of the valve structure. Downward motion of the cam follower 116 as a result of action of cam 124 will dump the low or vacuum pressure at atmosphere when the tray blank has been laid on the lug conveyor chains 82. The tray blank is then freed for feeding upwardly and to the right as viewed in FIGS. 1 and 3.

At predetermined times during the arm's cycle valve 112 will apply vacuum pressure for the vacuum cup device 102 by opening conduit 114 to the interior of tubular shaft 104 and the hollow interior of the arm 66 as described herein above. A split cam means 126 is provided on the end of drive shaft 128 associated with one of the drive sprockets 88 for the conveyor chain 82. The split cam configuration permits the vacuum to be dumped for the desired interval during each cycle of operation of the arm 76.

Drive shaft 128 for sprocket 88 also includes a portion 129 that is driven with the portion 128 through the interconnecting rock shaft 92 mentioned previously. Shaft 129 includes a cam 130 (the shape of which is best shown in FIG. 3) to reciprocate a cam follower 132 associated with slide element 134 provided in a fixed bracket assembly 156 below the magazine. Slide element 134 includes a pivoted pawl element 138 which element is spring biased upwardly by compression spring 140 and which pawl element 138 is pivotally connected to the slide element 134 as shown at 142. The free end of pawl 138 engages a toothed wheel or ratchet wheel 144 having peripherally spaced teeth such that the wheel 144 can be periodically index through a predetermined angular displacement as illustrated generally at 146 in FIG. 3. Ratchet wheel 144 is provided on shaft 108, so that shaft 108 and tubular shaft 104 to which it is connected, periodically rotate through an angular displacement 146 during each cycle of operation for the arm 76. This motion is utilized to operate the delrin plate chain conveyors 70, 70 as mentioned above. Sprockets 148, 148 are provided on the tubular shaft 104 for this purpose. These sprockets serve to periodically advance the delrin plate conveyor chain 70, 70 in timed relationship with oscillatory movement of the arm 76.

Still with reference to the mechanism provided below the magazine of FIG. 3, slide element 134 also serve to oscillate a lever 150 provided on a cross shaft 152 to oscillate the cross shaft 152 and thereby achieve horizontal reciprocating motion for the movable stops 74, 74. The upper end of lever 150 is connected to the stop by means of a pin and slot connection as indicted generally at 154. A spring 156 serves to bias the lever 150 in position for retracting the stop 74 against the endmost blank in the stack, and another spring 158 acts on the left hand end of slide element 134 to maintain contact between cam follower roll 132 and cam 130 in order to assure continuous cyclical motion of these various components.

Turning next to a more detailed description of the loading station itself, the tray blanks T are fed to the right and upwardly as viewed in FIG. 1, and in timed relationship with advancement of the groups of articles by the flights 16 so that both tray blank and articles move into the path of a pocket chain conveyor system. Outer chains are provided with front pockets 160, 160 and an inner or center chain carries trailing pockets 162, 162. FIG. 1 shows the leading pocket 160 in a series of positions corresponding to positions of the leading row of articles in the group of articles to be mated with the tray as both articles and tray arrive at the load station. In the first or initial position of the leading pocket defining element 160 the group of articles is in the solid line position shown. However, as the leading pocket defining element 160 moves to the next succeeding position **160*a* the tray blank is lifted to the broken line position shown and the group of advancing articles will have moved to a position indicated generally at A in FIG. 1. Further progress of the articles and of the tray blank together with upward movement of the leading pocket defining element 160 will see the front flap of the tray blank bent upwardly to the broken line position illustrated generally at B in FIG. 1. As the upwardly moving pocket defining element 160*d* advances further, the progress of the article group will result in the front flap being folded into an upright condition and securely held against the leading row of articles as the flight bar 16** cooperates with the leading pocket defining element 160b to define a pocket for the articles and tray blank prior to the time when both articles and tray are under exclusive control of the pocket conveyor system 164.

Figure 18:
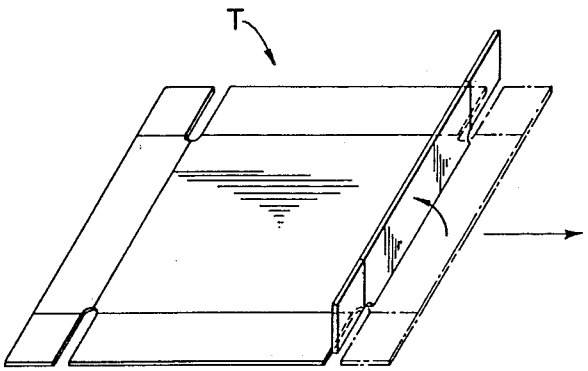
FIG. 18 shows a tray blank in flat configuration and with its front flap folded upwardly in broken and solid lines respectively.

Conveyor 164 includes these leading pocket defining elements 160 provided on the outside chains 164, 164. Camming means is provided adjacent the upstream end of the pocket chain conveyor for articulating said leading pocket element 160 in the manner just described. As so constructed and arranged the group of articles is mated with a tray blank, and the blank is preliminary folded at its front flap portion around the leading portion of the article group so that both articles and blank are moved downstream in the configuration shown in FIG. 18. The pocket chain trailing portion 162 will replace the flight bar 16 in controlling movement of the partially formed package.

Figure 7:
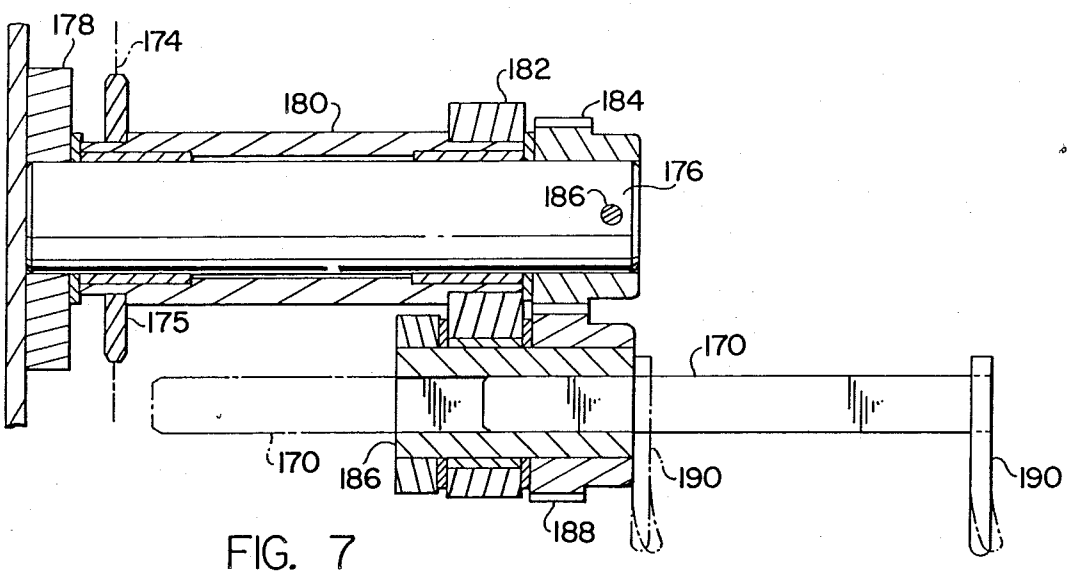
FIG. 7 and 7A are a detailed views of that portion of FIG. 2 illustrating the mechanism for folding the rear flap corner tabs of the tray blank after the rear flap has been folded, and illustrates the folder in two positions for accommodating tray of different width.
Figure 7A:
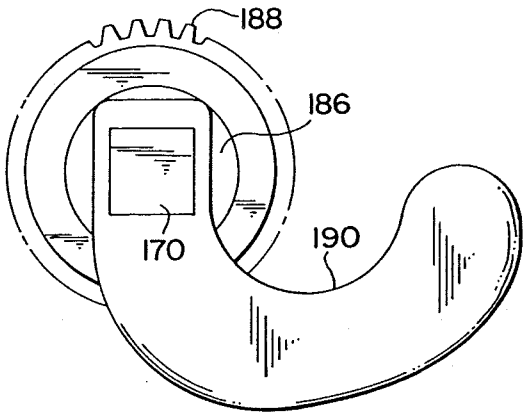
Figure 8:
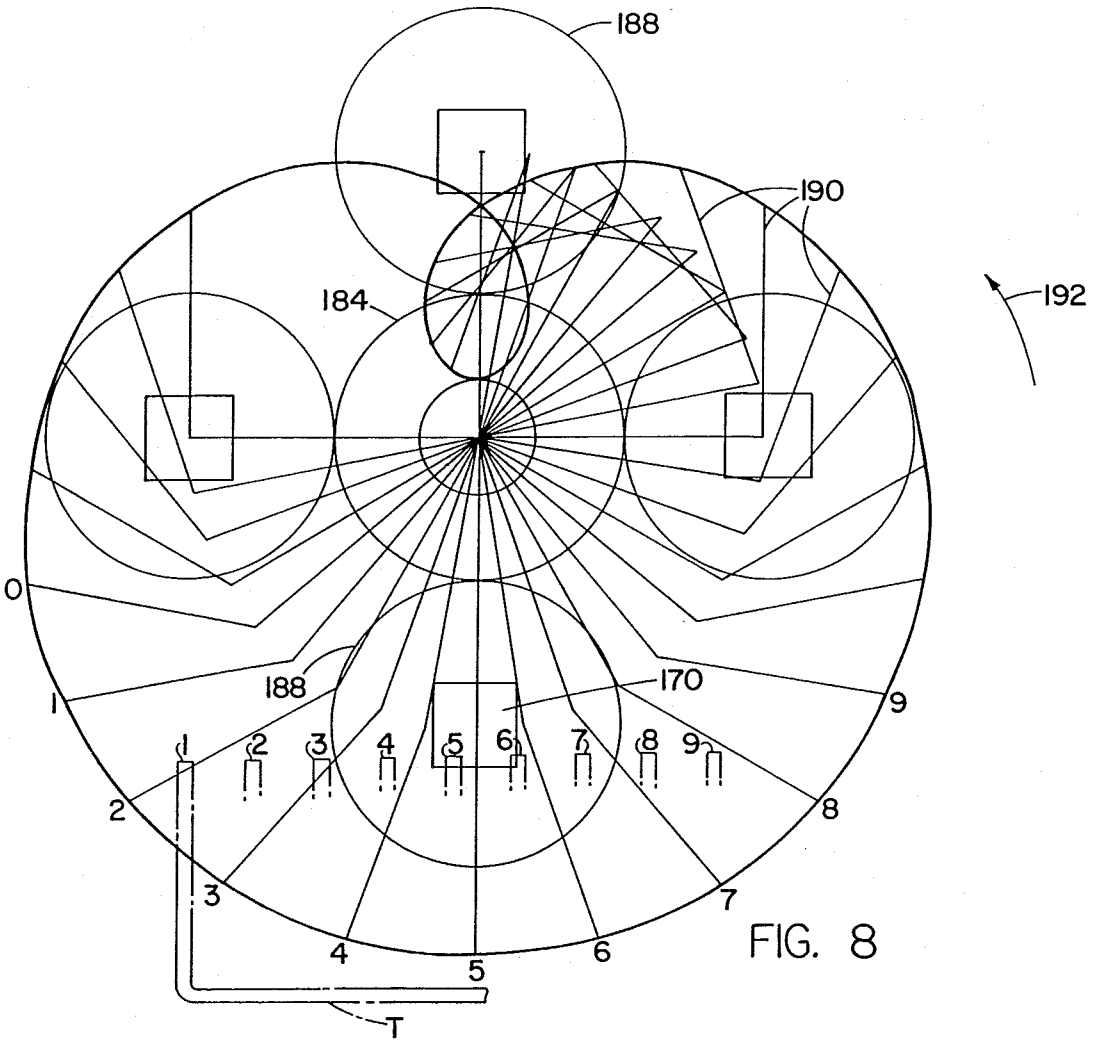
FIG. 8 illustrates in schematic fashion the speed of movement for the corner tab flap folder relative to the speed of movement of the tray blank, and illustrates the geometric orientation of the flap folder arm itself as is completes one cycle of movement for folding the corner tabs of one tray blank moving through the machine.
Figure 19:
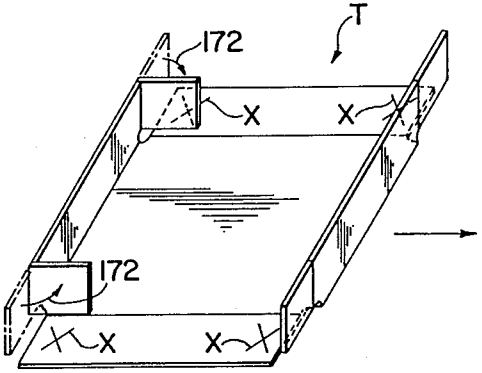
FIG. 19 shows the tray blank folded into a generally U-shape, and with rear flap corner tabs folded forwardly in broken and solid lines respectively.

As the trailing pocket defining element 162 moves upwardly around substantially the same axis as that followed by the leading flap closing pocket element 160 the rear flap of the tray will be folded upwardly around the trailing row in the group of articles and the tray blank will have assumed a generally U-shape around the group of articles as suggested generally in FIG. 19. Means is provided for folding the corner tabs associated with this rear flap in a forward direction, that is in the same direction of movement of the tray itself, and such means preferably comprise corner tab folders 170 and 170 provided for this purpose downstream of the flight bar conveyor system 16 described previously. FIG. 7 shows one of the two flap folding devices with the folder itself depicted in two positions to illustrate it's adjustability for handling trays of different size. FIG. 8 illustrates the path of motion for these folders as they travel through a cycle in connection with folding the corner tabs of a tray.

FIG. 19 illustrates the configuration for the tray both before and after folding of these corner tabs. Thus, the purpose of the flap folders illustrated in FIGS. 7 and 8 is to fold the rear flap corner tabs forwardly as illustrated by the arrows 172, 172 in FIG. 19.

The flight bar conveyor system, best shown in FIG. 2, for operating the flight bars 16, 16 includes power take-off chains 174, 174 that are adapted to operate flap folding shafts 180, 180. Two flap folding mechanisms are operated in synchronism, and therefor only one need be described in detail. As shown in FIG. 7 the spindle shaft 180 is tubular and rotatably supported on a stationary spindle 176. The tubular shaft 180 supports a crank arm structure 182 provided adjacent the outer end of the shaft 180 and a gear 184 is pinned to the fixed spindle as shown at 186. Thus, the input drive from chain 174 rotates sprocket 175 and therefore hollow shaft 180 so as to rotate crank arm 182 on the axis of fixed spindle shaft 176. The arm 182 also supports a slidable support rod 170 that is provided at one end with the flap folding element 190. The slidable element 170 is supported for rotation in a sleeve 186 that also carries gear 188. Gear 188 meshes with the gear 184 so as to be rotated thereby as the arm itself is rotated. As so constructed and arranged rotation of sprocket 175 will achieve a planetary motion for arm 190 as bes shown in FIG. 8. More particularly, the motion of the arm 190 is in the counter-clockwise direction as indicated generally by the arrow 192 in FIG. 8 and as this arm reaches the bottom left hand quadrant of its motion, indicated generally by the reference numeral 1 in FIG. 8, the tray blank T will have had its rear flap folded to an upright perpendicular relationship to the bottom panel of the tray blank as indicated generally by reference 1. The velocity of movement of the tray is indicated generally by reference numerals 1–9 inclusively the upper end portion of the tray blank rear flap is uniform, but the corresponding motion for the flap corner tab folder, as illustrated by use of the same reference numerals 1–9 shows an acceleration achieved between the flap folder and the tray blank to fold the corner tabs (not shown in FIG. 8) forwardly as suggested previously with reference to FIG. 19, all without interrupting the continuous motion of the tray blank and product through this portion of the machine.

The forward flap corner tabs are conventionally folded rearwardly by fixed plow means as shown at 194 in FIG. 1, and with the tray in such a configuration adhesive in the form of a hot melt glue is applied to regions X, X of the laterally outwardly projecting side flaps of the tray blank (See FIG. 19) so that these side flaps can be folded upwardly, as suggested at 196 in FIG. 2, by fixed plows (not shown) in order to form the tray around the group of articles. Finally, the upwardly folded tray flaps are held in compression in the area of the machine indicted generally at 198 in FIG. 2 by side belts or the like (not shown) to provide time for the setting of the adhesive. The product and tray, together with the partitions, are preferably further secured by the application of a shrink film wrap around the resulting product. This shrink film wrapping is accomplished after the pocket chain conveyor has released the package to further conveying means (not shown) associated with the heat shrink film wrapping operation.

Figure 16:
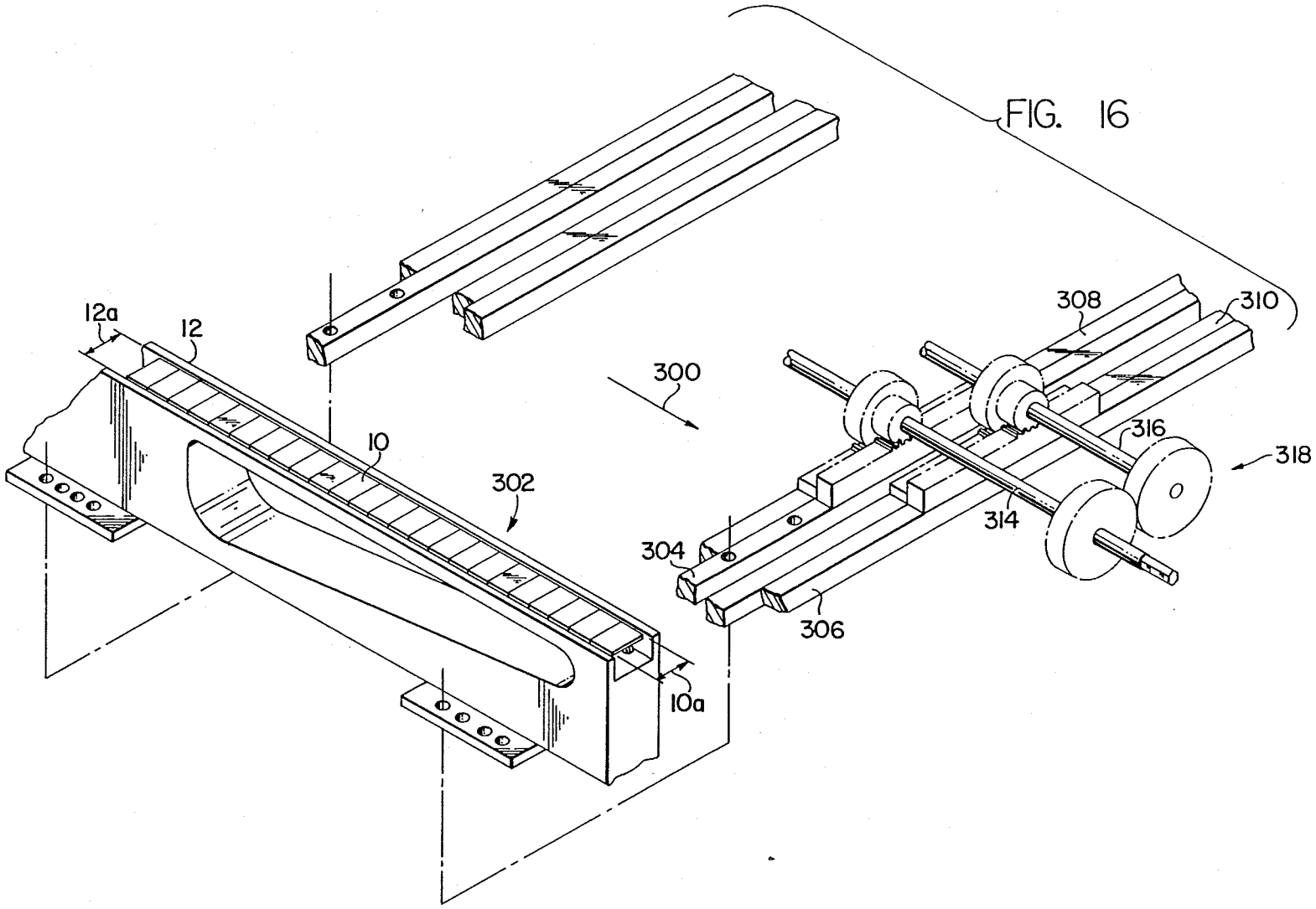
FIG. 16 is a perspective view with portion broken away to reveal the mechanism for adjustably positioning the lane guide dividers to accommodate articles of different body diameter or size.
Figure 17:
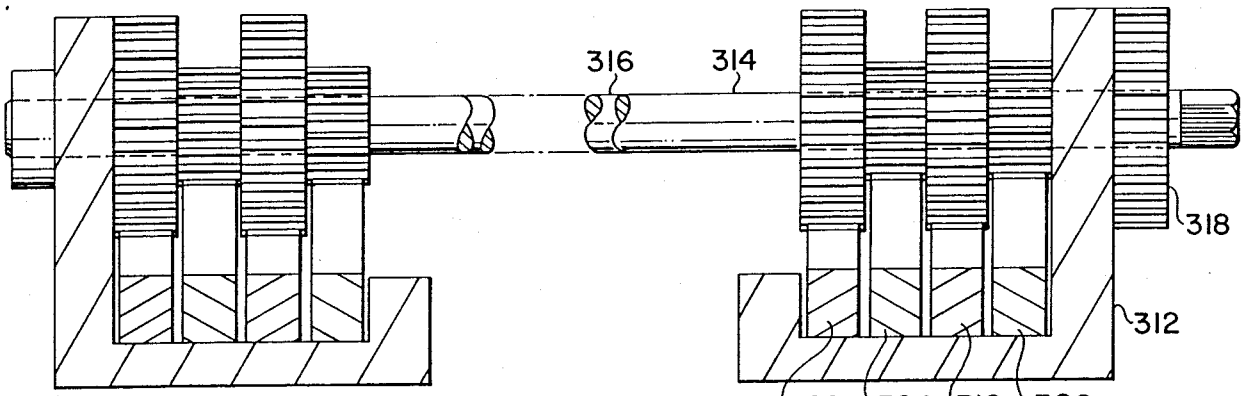
FIG. 17 is a vertical longitudinal section through the apparatus of FIG. 16.

The apparatus as described and shown is capable of accommodating articles of different size, and some of the above described features are included for this general purpose. FIGS. 16 and 17 show how the lane guides and associated lane conveyors can be adjustably moved laterally relative to one another. If the arrow 300 is taken to indicate the downstream direction, corresponding left and right lane guide assemblies 302 (only one being shown) are provided on associated support rails 304 and 306 as suggested in FIG. 16. Other support rails are provided on rails 308 and 310 for moving other corresponding left and right lane guide assemblies (not shown) through lateral displacements dictated by their lateral spacing relative the rail 302.

Each support rail 304–310 is slidably supported in a support frame 312 of the machine as shown in FIG. 17. Each rail also has a rack gear segment thereon as shown in FIG. 16, which segments mesh with spur gears of appropriate gear diameter to achieve the desired displacement of the lane guides relative to one another. More particularly, longitudinally extending shafts 314 and 316 carry these spur gears and reverse counter rotational movement of these shafts will shift the support rails in opposite directions through reversing pinions as indicated generally at 318. As so constructed and arranged the spacing between the lane defining means can be varied to accommodate articles of different size. Each individual lane conveyor is preferably movable with an adjacent lane guide means and the width of these conveyors is such that space is provided for the grouper pins when smaller size articles are being handled. FIG. 16 should show space between the lane guide divider plates 12, 12 and the lane conveyor 10. The lane conveyor 10 comprises a plurality of slip plates of width 10a somewhat less than the minimum spacing 12a between these lane divider plates.

We claim:

1. A continuous motion tray forming and product loading machine comprising:

a plurality of side-by-side individual lane conveyors for advancing cylindrical articles in the downstream direction in end-to-end relationship and in side-by-side rows, each said lane conveyor including a single chain, and links of said chain carrying plates that support the articles in a horizontal plane, first article engaging pin means for slowing the articles to create a space between adjacent rows, said individual lane conveyors continuously moving beneath the spaced rows of articles and beyond the downstream end of said article engaging pin means, second means for engaging groups of article rows so separated by said first article engaging pin means for handling groups downstream of said spaced rows and downstream of said first article engaging pin means, said individual lane conveyors also moving the rows of articles continuously through and at least to the downstream end of said second means, said first article engaging pin means comprising laterally spaced pin conveyor chains, a plurality of pin supporting flights supported by said laterally spaced chains, certain of said flights having cam follower rollers, said flights being pivotably moveable of said flights relative to said chain, camming means for said cam rollers, said camming means provided subadjacent to said horizontal plane, said camming means being movable longitudinally relative to the path of said pin conveyor chains, and adjustment means for moving said camming means to vary the angle at which said pins penetrate said horizontal plane to accommodate articles of different body diameter, and means defining a load station and means for feeding tray blanks to the lower station from a position below said horizontal plane, and pocket defining conveyor means for moving the tray blanks and article groups out of the load station.

2. The combination according to claim 1 further characterized by means for mounting said lane conveyors for limited lateral adjustment relative to one another in order to accommodate articles of different body diameter, and mechanical means for moving said lane conveyors differentially in the lateral direction.

3. The combination according to claim 2 further characterized by lane guides adjustably movable with an associated lane conveyor, said pin conveyor flights having pin supporting plates removably secured to said flights, a second set of pin plates with different pin spacing replacing said first mentioned pin plates to accommodate articles of different body diameter.

4. The combination according to claim 3 wherein said camming means comprises two vertically oriented cam plates provided outside of each said laterally spaced pin conveyor chain, and said cam followers provided on laterally projecting portions of said flights so configured as to position said cam followers in the opposite side of said pin conveyor chains from that of said removable pin plates.

5. The combination according to claim 4 wherein said pin conveyors include drive and idler chain sprockets and shafts, said pin conveyor drive shaft extending laterally through openings in said cam plates.

* * * * *